US010946233B1

(12) United States Patent
Neeley, Jr.

(10) Patent No.: US 10,946,233 B1
(45) Date of Patent: Mar. 16, 2021

(54) ANCHOR FOR EXERCISE SYSTEM

(71) Applicant: William Lawrence Neeley, Jr., Cambridge, MA (US)

(72) Inventor: William Lawrence Neeley, Jr., Cambridge, MA (US)

( * ) Notice: Subject to any disclaimer, the term of this patent is extended or adjusted under 35 U.S.C. 154(b) by 20 days.

(21) Appl. No.: 16/510,103

(22) Filed: Jul. 12, 2019

Related U.S. Application Data

(60) Provisional application No. 62/697,555, filed on Jul. 13, 2018, provisional application No. 62/703,312, filed on Jul. 25, 2018, provisional application No. 62/789,262, filed on Jan. 7, 2019.

(51) Int. Cl.

| | |
|---|---|
| ***A63B 21/16*** | (2006.01) |
| ***A63B 21/055*** | (2006.01) |
| *A63B 23/00* | (2006.01) |
| *A63B 21/04* | (2006.01) |
| *E05D 3/00* | (2006.01) |
| *E05D 3/02* | (2006.01) |
| *E05D 3/04* | (2006.01) |

(52) U.S. Cl.
CPC ..... *A63B 21/1663* (2013.01); *A63B 21/0557* (2013.01); *A63B 21/0442* (2013.01); *A63B 2023/006* (2013.01); *E05D 3/00* (2013.01); *E05D 3/02* (2013.01); *E05D 3/04* (2013.01)

(58) Field of Classification Search
CPC . A63B 21/1663; A63B 21/04; A63B 21/0442; A63B 21/0557; A63B 21/01627; A63B 21/1645; A63B 2023/006; A47G 25/0621; Y10T 16/522; E05C 17/025; E05D 11/06; E05D 11/00; E05D 3/02; E05D 3/00; E05D 3/04; E05D 5/128; E05D 2005/102
USPC ..... 16/223; 211/119.004; 482/213.1
See application file for complete search history.

(56) References Cited

U.S. PATENT DOCUMENTS

| | | | | |
|---|---|---|---|---|
| 914,697 A | | 3/1909 | Bryant | |
| 1,208,986 A | | 12/1916 | Krodel | |
| 2,176,723 A | | 10/1939 | Sauer | |
| 2,509,502 A | | 5/1950 | Hunt | |
| 2,595,521 A | | 5/1952 | Hanson | |
| 2,684,225 A | | 7/1954 | Johnson | |
| 2,895,698 A | | 7/1959 | Palmer | |
| 2,896,791 A | * | 7/1959 | Raber | A47G 25/0621 211/119.004 |
| 3,044,630 A | * | 7/1962 | Szabo | A47G 25/0621 211/119.004 |
| 3,825,127 A | | 7/1974 | Morrison et al. | |
| 4,721,212 A | | 1/1988 | Lowe | |

(Continued)

*Primary Examiner* — Megan Anderson
(74) *Attorney, Agent, or Firm* — Sunstein LLP

(57) ABSTRACT

A kit provides an anchor for an exercise system. The kit includes a mount having spaced-apart first and second knuckles configured (i) to span interlaced knuckles of first and second leaves of a standard hinge assembly that mounts a door in a frame in an opening, the interlaced set of knuckles defining a passageway for receiving an original hinge pin, and (ii) to define a channel having a diameter sufficient to accommodate the diameter of the hinge pin. The kit also includes a replacement hinge pin, which, when inserted into the channel and the passageway, reaches the first and second knuckles of the mount defining the channel, and transforms the mount to the anchor.

7 Claims, 13 Drawing Sheets

(56) References Cited

U.S. PATENT DOCUMENTS

| | | | | |
|---|---|---|---|---|
| 6,050,427 | A * | 4/2000 | Loveland | E05D 11/00 211/119.004 |
| 6,196,398 | B1 | 3/2001 | Lowe | |
| 6,712,228 | B2 | 3/2004 | Lowe | |
| 6,722,511 | B1 | 4/2004 | Lowe | |
| 10,465,843 | B2 * | 11/2019 | Mantella | E05D 11/00 |
| 2007/0272637 | A1 | 11/2007 | Rigas | |
| 2009/0119879 | A1 | 5/2009 | Rigas | |
| 2010/0108834 | A1 | 5/2010 | Rigas | |
| 2019/0352951 | A1 * | 11/2019 | Howson | E05D 5/128 |

* cited by examiner

ANCHOR FOR EXERCISE SYSTEM

PRIORITY

This patent application claims the benefit of U.S. provisional patent application No. 62/697,555, filed Jul. 13, 2018, U.S. provisional patent application No. 62/703,312, filed Jul. 25, 2018, and U.S. provisional patent application No. and 62/789,262, filed Jan. 7, 2019. Each of these applications is hereby incorporated, in its entirety, by reference.

TECHNICAL FIELD

The present invention relates to exercise systems, and more particularly to an anchor, for an exercise system, that is readily installed for use in a residential, commercial, or industrial setting.

BACKGROUND ART

Many exercise devices use inflexible and/or flexible members such as straps, bands, tubes and webbing to provide resistance for stretching and/or strengthening exercises. The resistance loads in these exercises, created via the extension of flexible members and/or the bodyweight of the user, can be very high, reaching hundreds of pounds. Mechanisms which can support these resistance loads are needed for attaching such members.

SUMMARY OF THE EMBODIMENTS

In accordance with one embodiment of the invention, there is provided a method of providing an anchor for an exercise system. The method includes removing an original hinge pin from a hinge assembly that mounts a door in a frame in an opening. The hinge assembly includes a first leaf mounted to the frame and a second leaf mounted to the door. Each of the first and second leaves has an interlaced set of knuckles that define a passageway for the hinge pin. The method also includes positioning a mount having spaced-apart first and second knuckles configured (i) to span the interlaced knuckles of the first and second leaves and (ii) to define a channel, so that when the mount is positioned, the channel is aligned with the passageway. The method further includes installing a replacement hinge pin, longer than the original hinge pin, so as to occupy the passageway and the channel and to transform the mount into an anchor.

In accordance with one embodiment of the invention, there is provided a kit to provide an anchor for an exercise system. The kit includes a mount having spaced-apart first and second knuckles configured (i) to span interlaced knuckles of first and second leaves of a standard hinge assembly that mounts a door in a frame in an opening, the interlaced set of knuckles defining a passageway for receiving an original hinge pin, and (ii) to define a channel having a diameter sufficient to accommodate the diameter of the hinge pin. The kit also includes a replacement hinge pin having a diameter that is not greater than a diameter of the passageway pin and a length sufficient so that, when the mount is positioned so that the channel is aligned with the passageway, the replacement hinge pin, when inserted into the channel and the passageway, reaches the first and second knuckles of the mount defining the channel.

Optionally, the kit further includes a set of adapter shims. Each adapter shim is configured, in use, to be disposed between the first and second knuckles of the mount and including an axial bore therethrough that is aligned with the channel when such adapter shim is in use, so as to receive therethrough the replacement hinge pin. The set of adapter shims has axial dimensions sufficient to consume a preponderance of any axial distance, between the first and second knuckles of the mount, that remains after considering the axial distance of the interlaced set of knuckles. Alternatively or additionally, each adapter shim is further configured to include (i) a primary section, occupying a majority of such adapter shim's axial length and (ii) a stub section, occupying a minority of such adapter shim's axial length. The stub section has an outside diameter that is smaller than an outside diameter of the primary section, and the channel of an inner portion of each knuckle of the mount is provided with an internal shoulder formed to receive the stub section. Alternatively or additionally, the mount includes a hole disposed therein to receive a clip for attaching an exercise system thereto. Alternatively or additionally, the axial distance between the first and second knuckles of the mount is 3½ inches to accommodate a standard 3½ inch hinge assembly. Alternatively or additionally, the axial distance between the first and second knuckles of the mount is 4½ inches to accommodate a standard 4½ inch hinge assembly, and adapter shims can be attached to the first and second knuckles to accommodate a standard 3½ inch door hinge assembly.

BRIEF DESCRIPTION OF THE DRAWINGS

The foregoing features of embodiments will be more readily understood by reference to the following detailed description, taken with reference to the accompanying drawings, in which.

DETAILED DESCRIPTION OF SPECIFIC EMBODIMENTS

Definitions. As used in this description and the accompanying claims, the following terms shall have the meanings indicated, unless the context otherwise requires:

A "set" includes at least one member.

An "anchor" is a device that is constrained so as to move in space, if at all, within at most a single degree of freedom.

An "exercise system" is a set of interconnected members, each member being independently selected from the group consisting of rigid, flexible, and combinations thereof, configured to receive an application of external force attributable to a user so as to provide exercise to the user.

The term "exercise" includes physical effort by a user for purposes selected from the group consisting of physical conditioning, balance, stabilization, support, stretching, health, training, physical improvement, physical therapy, rehabilitation, and combinations thereof.

Embodiments of the present invention provide a door anchor for use with exercise devices and systems. In these embodiments, the door anchor is portable and can conveniently be used at varying locations, such as home, at a hotel, at the office, etc. Embodiments of the door anchor provide a mechanism that can support the resistance load caused by the use of the exercise devices and systems. Embodiments of the door anchor securely attach to a door hinge, which is normally used to mount a door in a frame of an opening, to provide a stable and secure mount for these exercise devices and systems. Embodiments of the door anchor include a hinge mount and replacement hinge pin for securely attaching the door anchor to a door hinge. Embodiments of the door anchor also include a hole to receive a clip (e.g., a carabiner) for attaching the exercise devices and systems to the door anchor.

Figure 1:
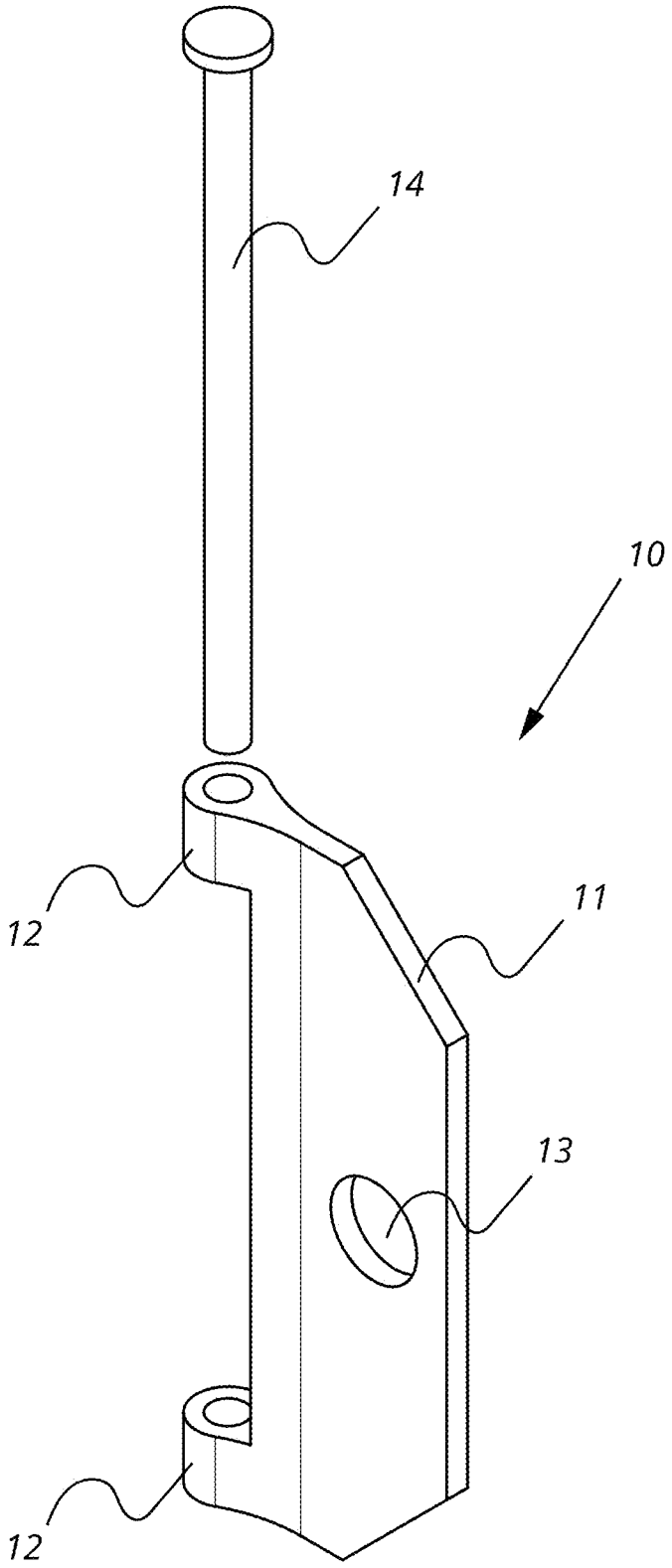
FIG. 1 is an exploded perspective view of a hinge mount and a replacement hinge pin in accordance with an embodiment of the present invention.

FIG. 1 is an exploded perspective view of a hinge mount and a replacement hinge pin in accordance with an embodiment of the present invention. The hinge mount 11 and hinge replacement pin 14 in FIG. 1 are components of a door anchor 10, which can be used to attach an exercise system to a door hinge. The hinge mount 11 and replacement hinge pin 14 may be provided as a door anchor kit.

Figure 4:
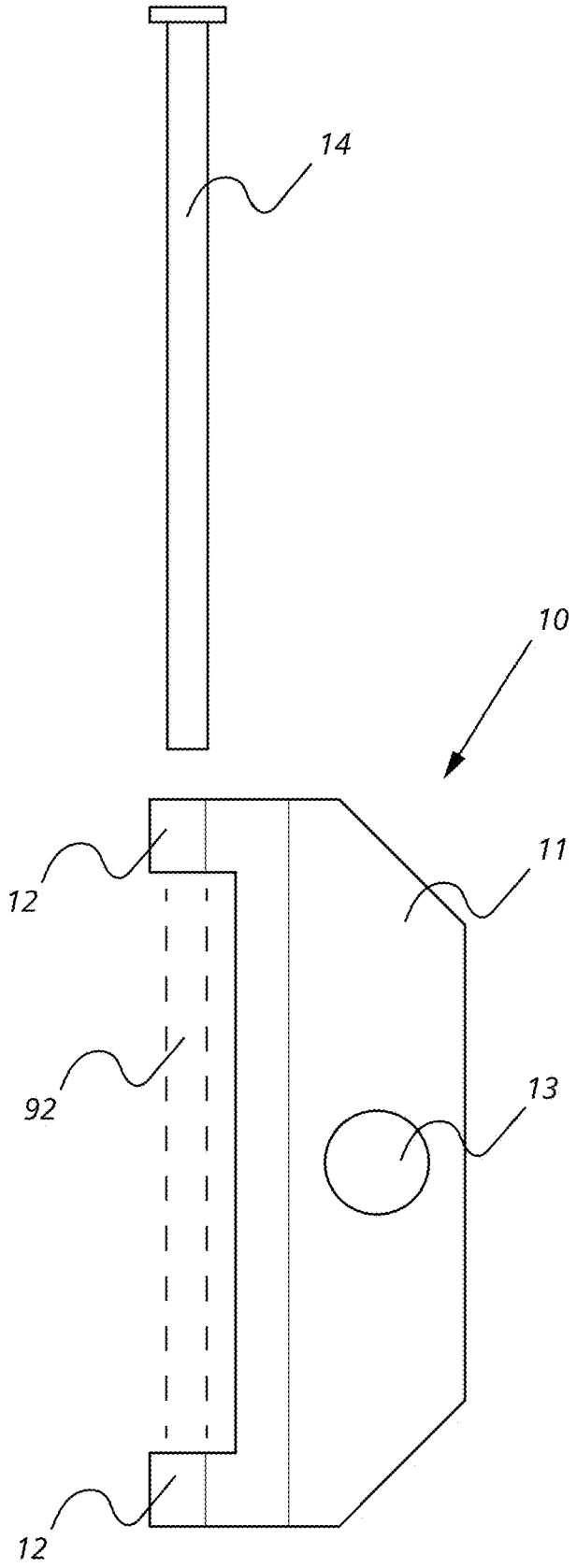
FIG. 4 is a side view of the embodiment of the hinge mount and the replacement hinge pin of FIG. 1.

The hinge mount 11 includes knuckles 12, which each provides a point where the hinge mount 11 can be attached to a door hinge. FIG. 1 shows the hinge mount 11 includes two knuckles (an upper and lower knuckle) 12, but in other embodiments, the hinge mount 11 may include any number of knuckles, without limitation. The replacement hinge pin 14 can be inserted through the knuckles 12, positioned at a door hinge, to attach the hinge mount 11 to the door hinge. The hinge mount 11 also includes a hole 13 to receive a clip for attaching an exercise system to the door anchor 10. FIG. 1 shows the hinge mount 11 including one hole 13, but in other embodiments, the hinge mount may include additional holes. FIG. 1 also shows the hole 13 as circular, but in other embodiments, the hole 13 may be in a different shape. FIG. 4 is a side view of the embodiment of the hinge mount and replacement hinge pin of FIG. 1.

The hinge mount 11 is the structural base upon which the other functional components (e.g., knuckles 12 and hole 13) of the door anchor 10 are built. In FIG. 1, the material and structure of the hinge mount 11 provide a geometry that connects (i) on one side, the hinge interface, including the knuckles 12 that provides at least one point of attachment to a door hinge, and, (ii) on the opposite side, the load interface, including the hole 13 that provides at least one point of attachment to the exercise equipment. In embodiments, the hinge mount 11 is made of rigid material that spans the space between the hinge interface, including the knuckles 12, and the load interface, including the hole 13. The hinge mount 11 can be made of suitable rigid material, such as plastic, metal, composites, etc., and the hinge mount 11 can be formed in other geometries. The replacement hinge pin 14 may be made of suitable material that is the same as or different from that of the hinge mount 11.

Figure 2:
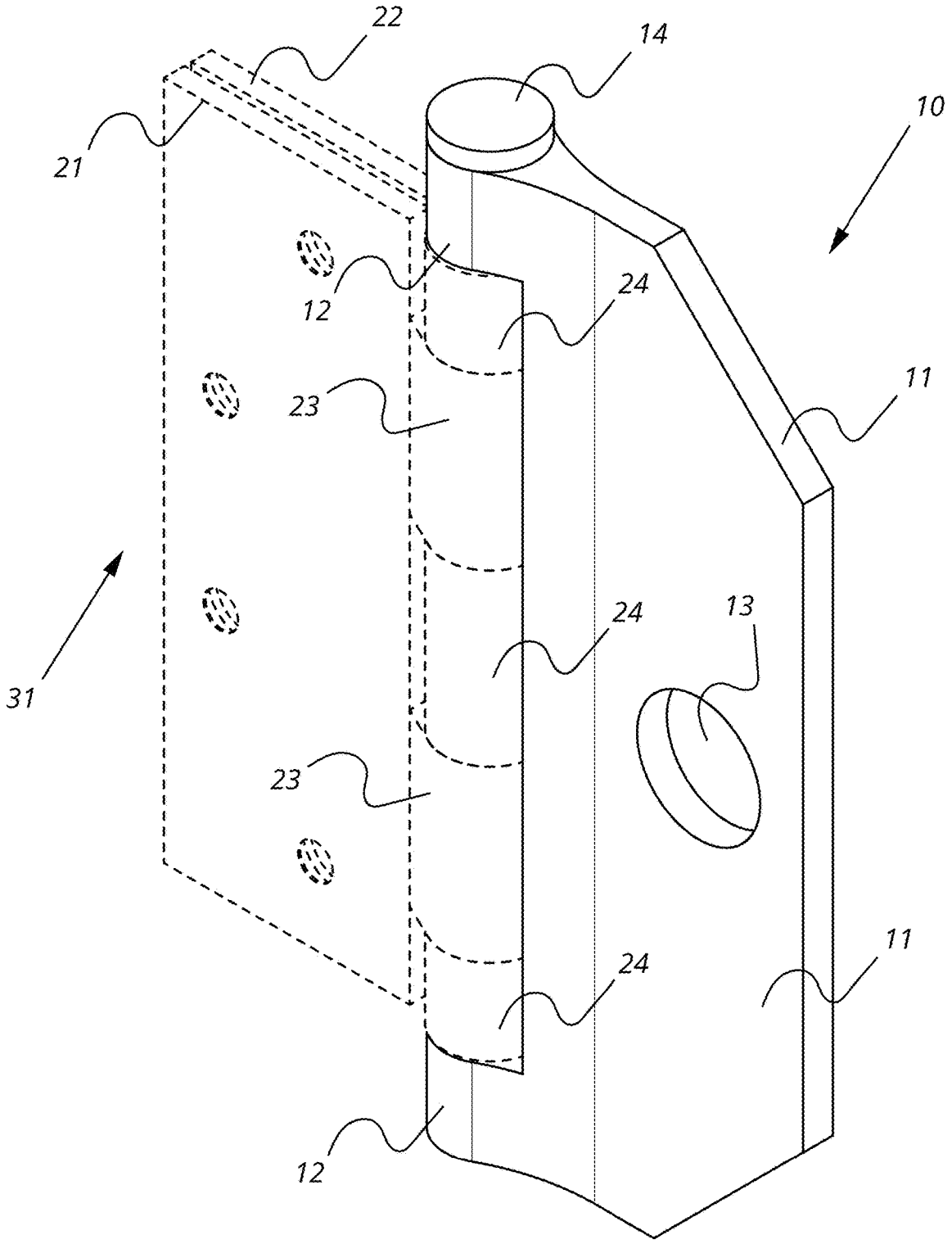
FIG. 2 is a perspective view of the hinge mount and the replacement hinge pin of FIG. 1 as installed on a door hinge in accordance with an embodiment of the present invention.
Figure 9:
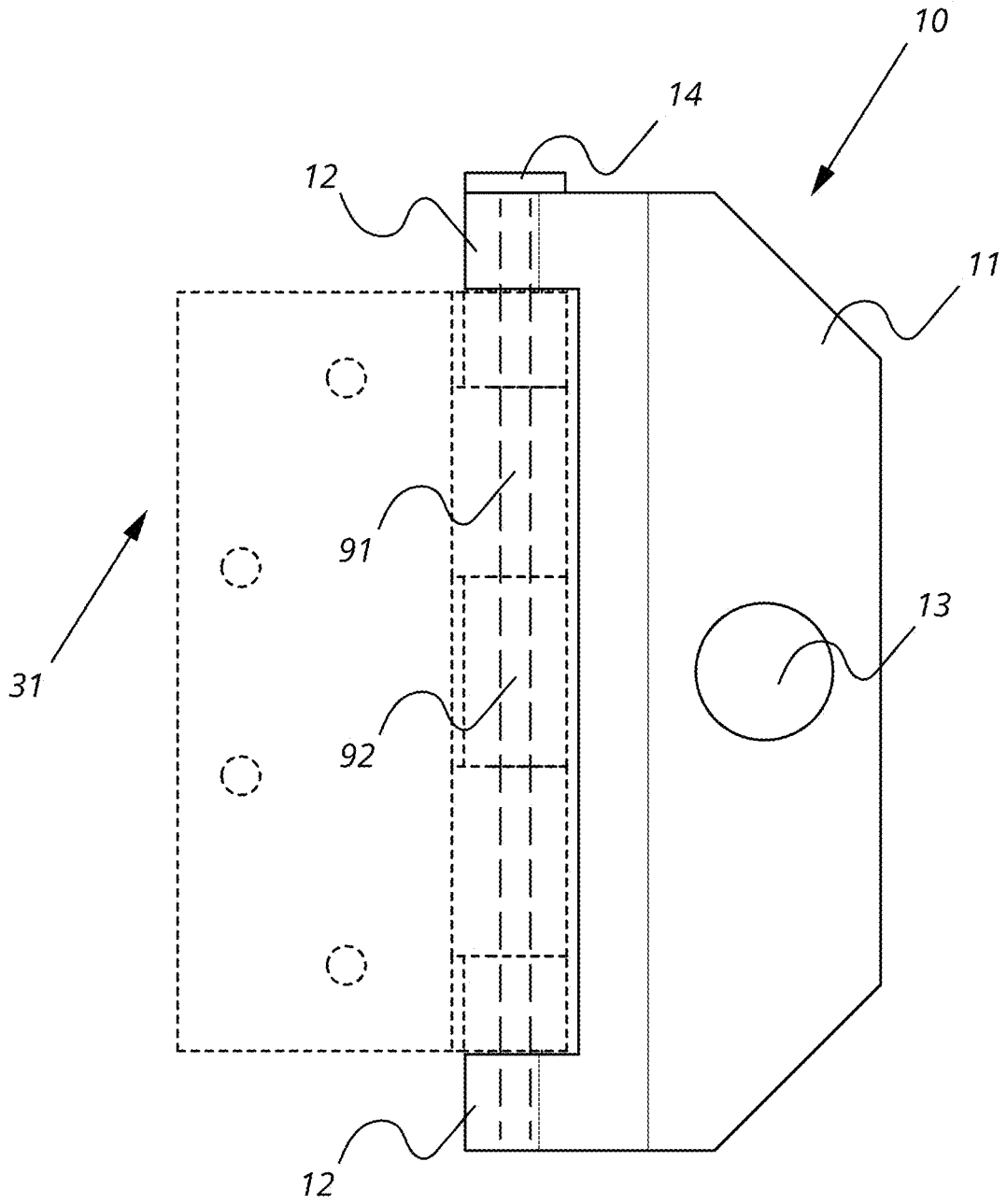
FIG. 9 is a side view of the embodiment of FIG. 2.
Figure 13:
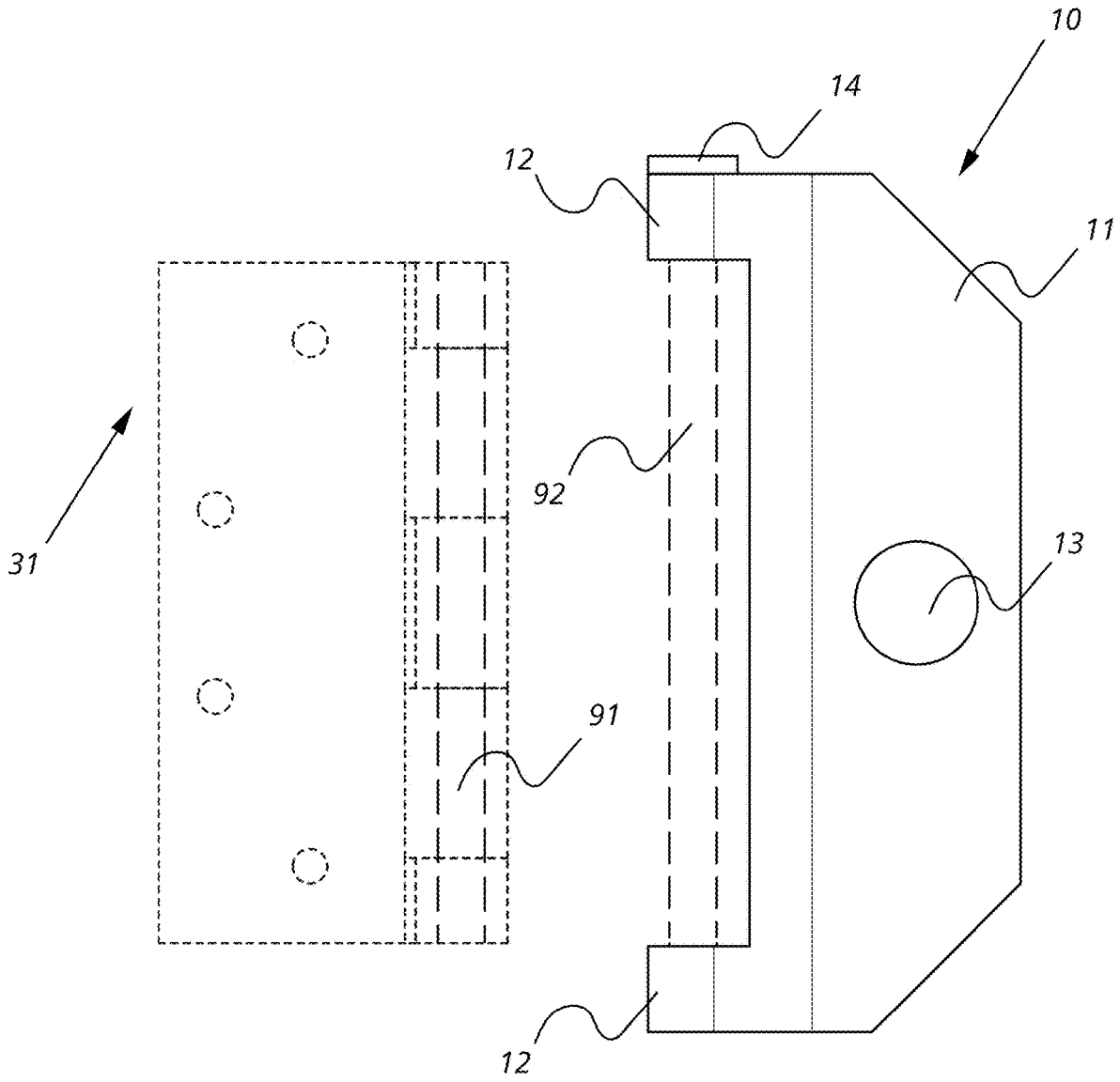
FIG. 13 is a side view of the hinge mount and the replacement hinge pin of FIG. 1, further indicating the passageway of the original hinge pin and channel defined by the knuckles of the hinge mount in accordance with an embodiment of the present invention.

FIG. 2 is a perspective view of the hinge mount and the replacement hinge pin of FIG. 1 as installed on a door hinge in accordance with an embodiment of the present invention. FIG. 9 is a side view of the embodiment of FIG. 2. FIG. 13 is a side view of the hinge mount and the replacement hinge pin of FIG. 1, further indicating the passageway of the original hinge pin and channel defined by the knuckles of the hinge mount in accordance with an embodiment of the present invention.

FIG. 2 shows a door hinge 31 that mounts a door in a frame in an opening (e.g., doorway). The door hinge 31 includes a first leaf 21 for mounting to the frame, and a second leaf 22 for mounting to the door. The first leaf 21 has a first interlaced set of knuckles 23 and the second leaf 22 has a second interfaced set of knuckles 24, which together define a passageway 91 (as shown in FIG. 13) used for receiving the original hinge pin of the door.

In FIG. 2 the original hinge pin of the door has been removed from the door hinge 31, and hinge mount 11 is installed on the door hinge 31 using the replacement hinge pin 14. To achieve the installation, the spaced-apart upper and lower knuckles 12 of the hinge mount 11 are configured to span the interlaced knuckles 23, 24 of the first and second leaves 21, 22 and define (as shown in FIGS. 9 and 13) a channel 92. As shown in further detail in FIG. 13, when the hinge mount 11 is positioned for use in conjunction with the door hinge 31, the channel 92 defined by upper and lower knuckles 12 of the hinge mount 11 is aligned with the passageway 91 used for the original hinge pin of the door. The defined channel 92 has a diameter that is sufficient to accommodate the diameter of the replacement hinge pin 14. In an embodiment, the knuckles 12 have an outer diameter similar to that of the geometry of the door hinge 31 so as to minimize obstruction with the door.

In some embodiments, such as FIG. 2, the knuckles 12 are the components that allow the hinge mount 11 to attach to the door hinge 31, such as to resist the pulling (or pushing) of an attached exercise load, while also allowing the full rotation of the door and the door anchor 10. In an embodiment, the knuckles 12 have a nominally cylindrical geometry with an inner diameter similar to that of the knuckles 23, 24 of the door hinge 31, such that the hinge mount 11 can receive a replacement hinge pin 14 of similar diameter as that of the original door hinge pin. In some embodiments, the hinge mount 11 is equipped with only a single upper knuckle 12 or a single lower knuckle 12, or other hinge attachment point, so as to enable the use of a shorter replacement hinge pin 14 and to afford other geometric advantages. In some embodiments, the hinge mount 11 has three or more attachment points on the hinge mount 11, which may include one or more cylindrical attachment elements, in addition to the upper and lower knuckles 12 shown in FIG. 2. These attachment points may be configured to work with an alternative door hinge, such that the attachment points occupy the location typically occupied by the knuckles 23, 24 of a traditional door hinge. This embodiment with the additional attachments elements further increases the load-handling capacity of the door anchor.

In FIG. 2, the replacement hinge pin 14 is inserted into the defined channel 92 and passageway 91 to securely attach the hinge mount 11 to the door hinge 31. The replacement hinge pin 14 has a diameter that is not greater than a diameter of the original hinge pin of the door. The replacement hinge pin 14 is also of sufficient length, so that, when so inserted, replacement hinge pin 14 occupies the passageway 91 and the channel 92, such that replacement hinge pin 14 reaches the first and second knuckles 12 of the hinge mount 11 defining the channel 92.

In some embodiments, the replacement hinge pin 14 is a straight steel pin with a nominal diameter of approximately 0.23 inches for the body of the pin with a flat head that has a larger diameter to prevent the pin from falling through the knuckles 12 of the hinge mount 11 and hinge 31. In some embodiments, the diameter of the replacement hinge pin 14 is designed to allow a slip fit with the knuckles 12 and the hinge 31. In some embodiments, the replacement hinge pin 14 is wider just beneath the head of the replacement hinge pin 14 to allow a slight press fit between the replacement hinge pin 14 and the knuckles 12, which act to secure the replacement hinge pin 14 in place, while also allowing easy removal of the replacement hinge pin 14 with minimal force. In some embodiments, the length of the replacement hinge pin 14 is such that it passes fully through the upper knuckle 12 and the hinge 31, and it terminates at the bottom of the lower knuckle 12 or just before. Other embodiments allow for a longer replacement hinge pin 14, which fits above the head and/or below the bottom of the lower knuckle 12. This additional length of the replacement hinge pin can be used as a point of additional attachment for exercise systems.

In an embodiment, the geometry of the hinge mount 11 is angled such that, when the hinge mount 11 lies flush with the surface of the door having the door hinge to which the hinge mount 11 is installed, the knuckles 12 are positioned off from the door at a sufficient distance to allow the attachment of the exercise system without interference with the function of the door. In an embodiment, the geometry of the hinge mount 11 is configured so that the hinge mount 11 does not interfere with the leaves 21, 22 of the door hinge, at either extent of the door travel, such that the geometry does not interfere with the full swing of the door.

Figure 3:
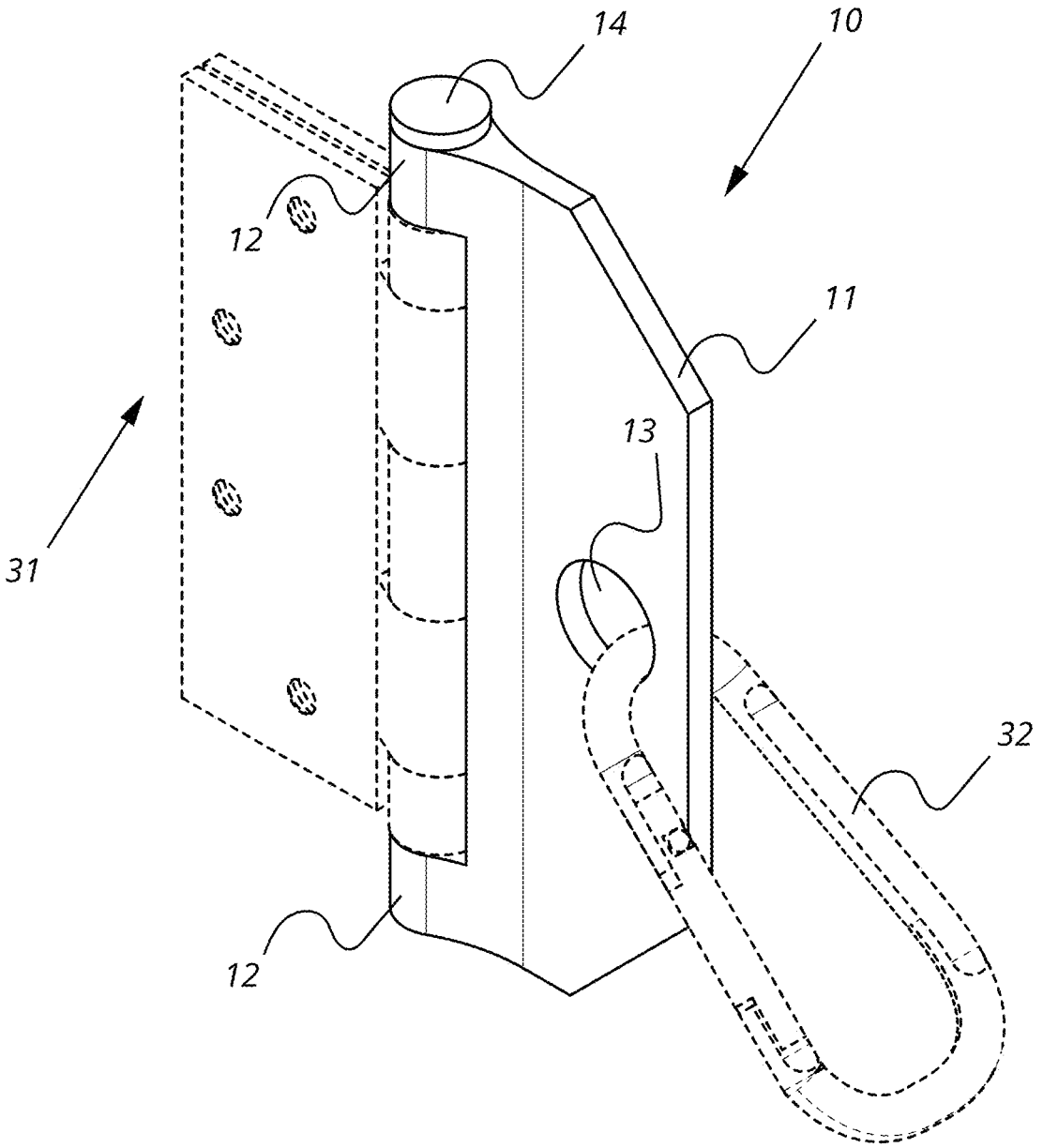
FIG. 3 is a perspective view of the hinge mount and the replacement hinge pin of FIG. 1 as installed on a door hinge with a clip attached.

FIG. 3 is a perspective view of the hinge mount and replacement hinge pin of FIG. 1 as installed on a door hinge with a clip attached. FIG. 3 illustrates the door anchor 10 attached to a door hinge 31, as shown in FIG. 2, with a clip 32 (e.g., a carabiner) now attached to the hole 13 of the hinge mount 11.

Figure 10:
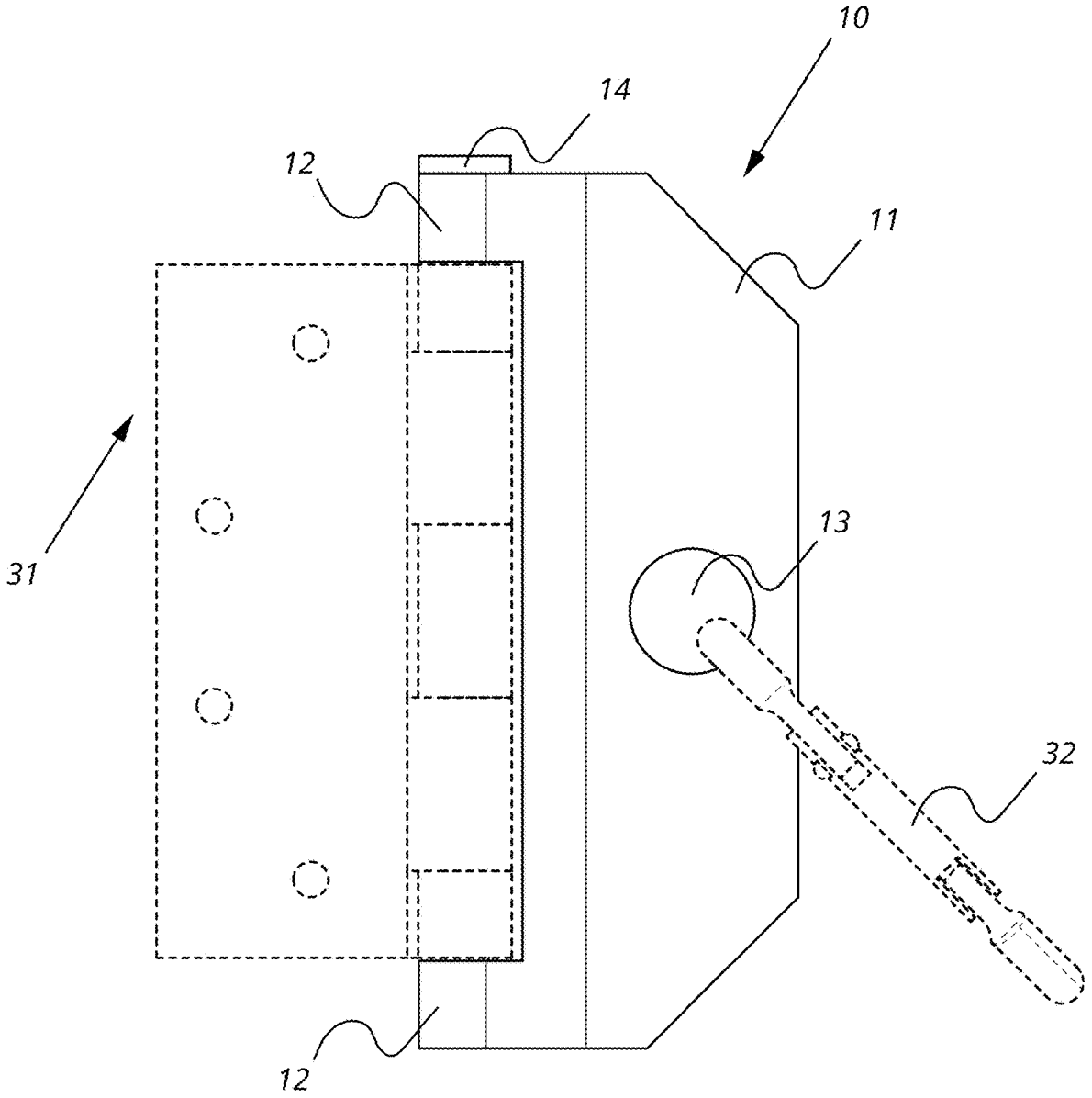
FIG. 10 is a side view of the embodiment of FIG. 3.

Holes, such as hole 13 in FIG. 3, on the hinge mount 11 provide locations where exercise systems may be attached to the door anchor 10. In the present embodiment of FIG. 3, the hinge mount 11 has a circular hole approximately one inch in diameter. Such an opening easily allows the attachment of a clip 32, such as a carabiner (as shown in FIG. 3), a looped strap, tubing or webbing, or other device as part of an exercise system. Embodiments allow the attachment of various loads and connectors. For example, an embodiment of the hole of the hinge mount 11 is a narrow rectangular slot that is nominally one inch tall and ¼ inch wide to receive a nylon strap. Alternate slot or hole geometries can be sized on the hinge mount 11 to receive straps of different geometries. Other embodiments and associated geometries allow the attachment of screws, hooks or other hardware to the hinge mount 11 based upon the exercise system or devices used. FIG. 10 is a side view of the embodiment of FIG. 3.

Figure 5:
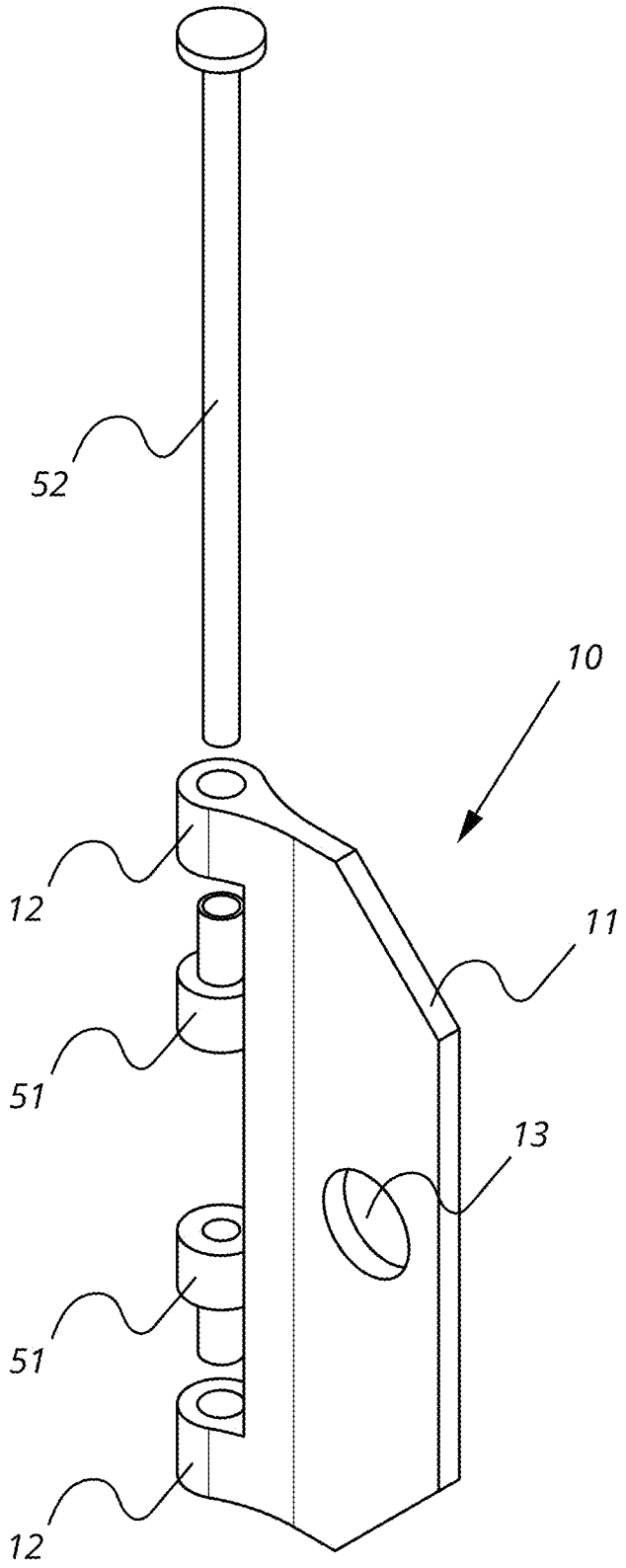
FIG. 5 is an exploded perspective view of a hinge mount and a replacement hinge pin with adapter shims to accommodate a range of hinge leaves in accordance with an embodiment of the present invention.
Figure 6:
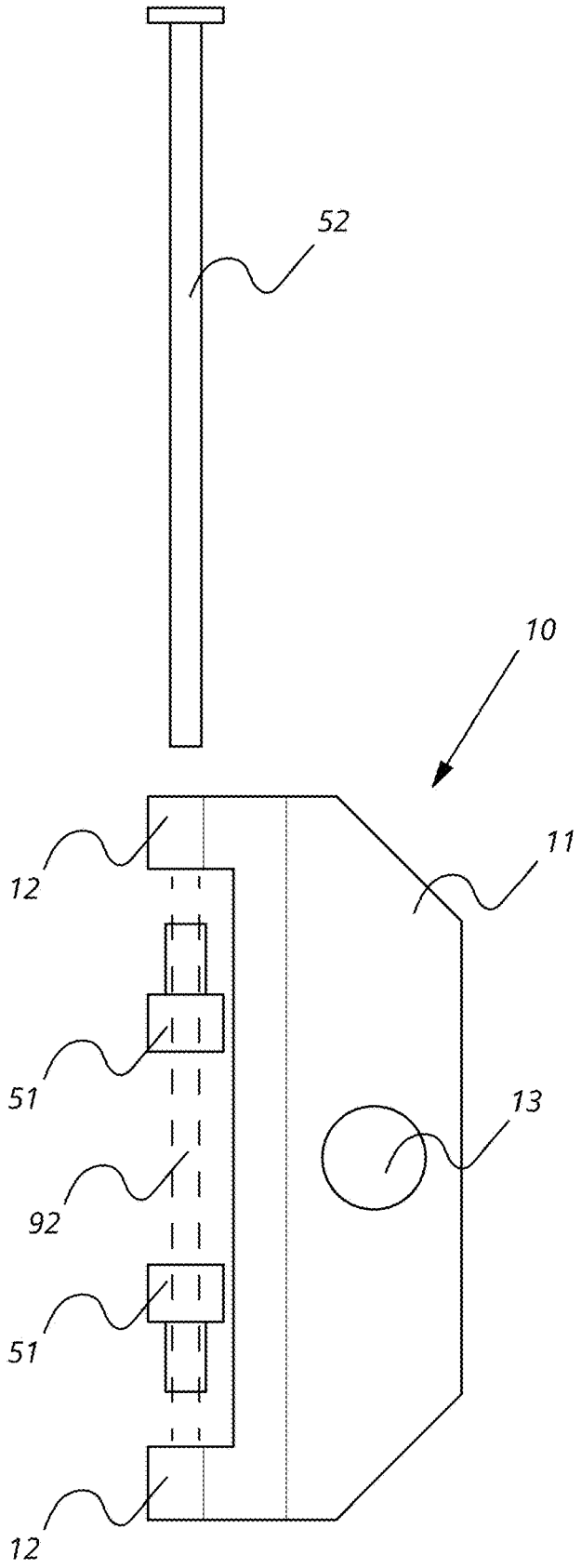
FIG. 6 is a side view of the embodiment of FIG. 5.

FIG. 5 is an exploded perspective view of a hinge mount and a replacement hinge pin with adapter shims to accommodate a range of hinge leaves in accordance with an embodiment of the present invention. FIG. 6 is a side view of the embodiment of FIG. 5.

The adapter shims 51 of FIG. 5 fit into the knuckles 12 of the hinge mount 11 to enable use of the door anchor 10 on hinges of various sizes. For example, whereas a typical residential door may use hinges that are nominally 3½ inches in height, commercial doors are typically heavier and larger and may use hinges that are nominally 4½ inches in height (while also being larger in other dimensions). Standard hinges are also made in other (though less common) sizes, and embodiments of the adapter shims 51 enable use of the door anchor with these other sizes of standard hinges. In alternative embodiments, to accommodate multiple door and hinge sizes, the door anchor 10 may be sized to accommodate the largest hinge that a user might encounter and then use one or more adapter shims 51 to allow that larger-sized door anchor to be adapted to use on smaller hinges.

In some embodiments, the door anchor 10 is sized such that the hinge mount 11 and knuckles 12 are sized relative to the dimensions (height, barrel diameter, etc.) of the largest door hinge in which the door anchor 10 is configured to be attached. Adapter shims 51 may be then used to reduce the axial span of knuckles 12 of the hinge mount 11, such that the span is reduced to accommodate the smaller-height of the interleaved knuckles of a smaller door hinge. The smaller door hinge of FIG. 5 in normal use utilizes a hinge pin that is smaller in diameter than the larger door hinge of FIG. 1 in normal use. As a result, the replacement hinge pin 52 in FIG. 5 has a smaller diameter than the replacement hinge pin 14 in FIG. 1. In an embodiment of FIG. 5, it is apparent that each adapter shim 51 has a portion that is inserted into the knuckle 12 of the hinge mount 11, with the effect of decreasing the available inner diameter of the knuckle 12 to receive the replacement hinge pin 52. This change in geometry can be addressed by providing initially a greater inner diameter of the knuckles 12 of the hinge mount 11, so that the adapter shim 51 can be provisioned with an axial bore sufficient in diameter to accommodate the replacement hinge pin 52. In the event that the hinge mount 11 of FIG. 5 is used without adapter shims 51 so as to accommodate the large hinge of FIG. 2, then the hinge mount 11 is supplied with an additional replacement pin 14 that is larger in diameter than the replacement pin 52. In embodiments, the adapter shims 51 consume the vertical difference between the height of a shorter-sized hinge (e.g., of 3.5" door hinge assembly) and the height of a longer-sized hinge (e.g., of 4.5" door hinge assembly). Beyond providing the function of accommodating the desired (smaller) hinge height and pin, the adapter shims 51 may also be designed such that they occupy any amount of additional space as desired for aesthetics or other function.

Figure 11:
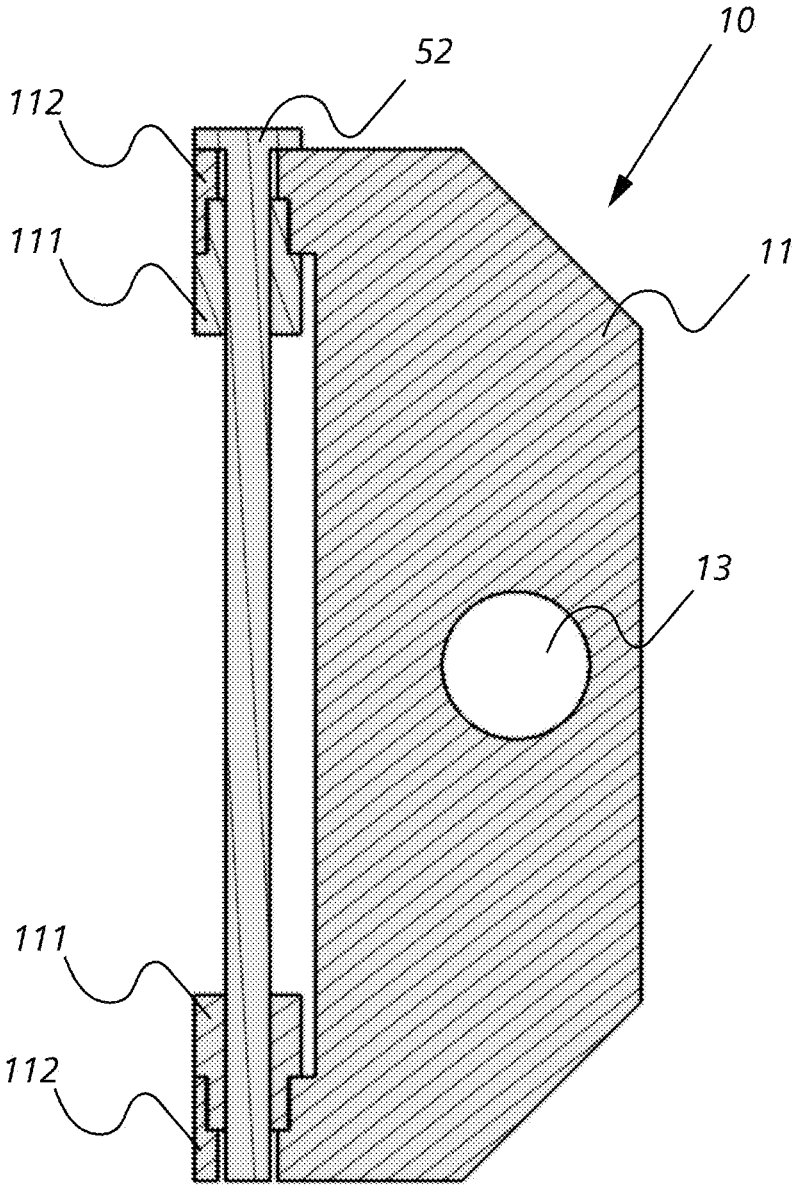
FIG. 11 is a longitudinal section of a hinge mount, a replacement hinge pin, with adapter shims connected to form a secure attachment in accordance with a further embodiment of the present invention.

FIG. 11 is a longitudinal section of a hinge mount, a replacement hinge pin, with adapter shims connected to form a secure attachment in accordance with a further embodiment of the present invention. In FIG. 11, the stub sections of the adapter shims 111 are inserted into the knuckles 112, so as to reduce the diameter of the inner portion of the knuckles 112. The replacement hinge pin 52 of smaller diameter, corresponding to the replacement hinge pin 52 of FIG. 5, is inserted through the reduced-diameter inner portion of the knuckles 112 and adapter shims 111 to form a secure attachment of the replacement hinge pin 52 to the hinge mount 11.

As shown in FIG. 11, each adapter shim 111 is configured to include a primary section, occupying a majority of such adapter shim's axial length, and a stub section, occupying a minority of such adapter shim's axial length. The stub section has an outside diameter that is smaller than an outside diameter of the primary section. The channel of an inner portion of each knuckle 112 of the hinge mount 11 is provided with an internal shoulder formed to receive the stub section. Note, in embodiments, such relationship between the length of the knuckles and the length of the adapter shims is not functionally required. For example, in an embodiment, the knuckles of that embodiment may be arbitrarily long and then the stub section on the adapter shims of that embodiment may be much longer than the primary section of the adapter shims.

Figure 12:
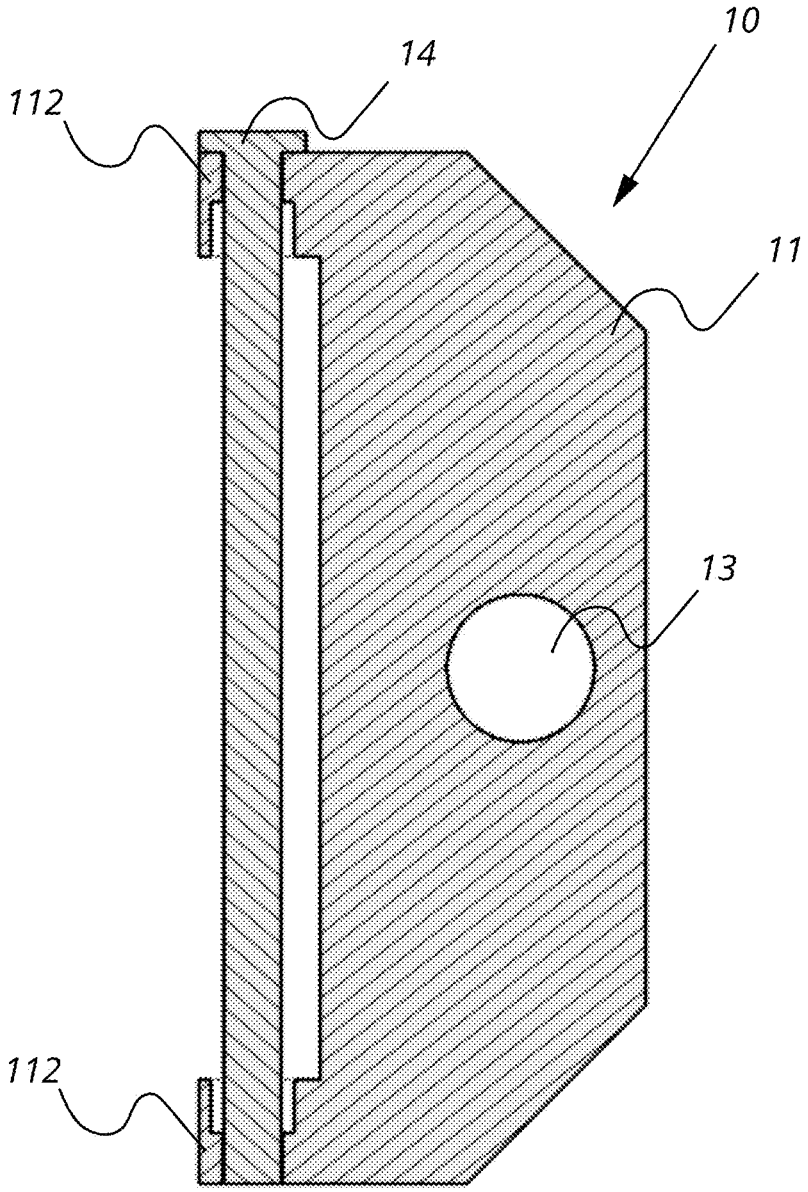
FIG. 12 is a longitudinal section of the hinge mount of FIG. 11 and the replacement hinge pin of FIG. 1 connected to form a secure attachment in accordance with an embodiment of the present invention.

FIG. 12 is a longitudinal section of the hinge mount of FIG. 11 and the replacement hinge pin 14 of FIG. 1 connected to form a secure attachment in accordance with an embodiment of the present invention. In FIG. 12, the replacement hinge pin 14 has been inserted through the inner portion of the knuckles 112 to form a secure attachment of the replacement hinge pin 14 to the hinge mount 11.

Figure 7:
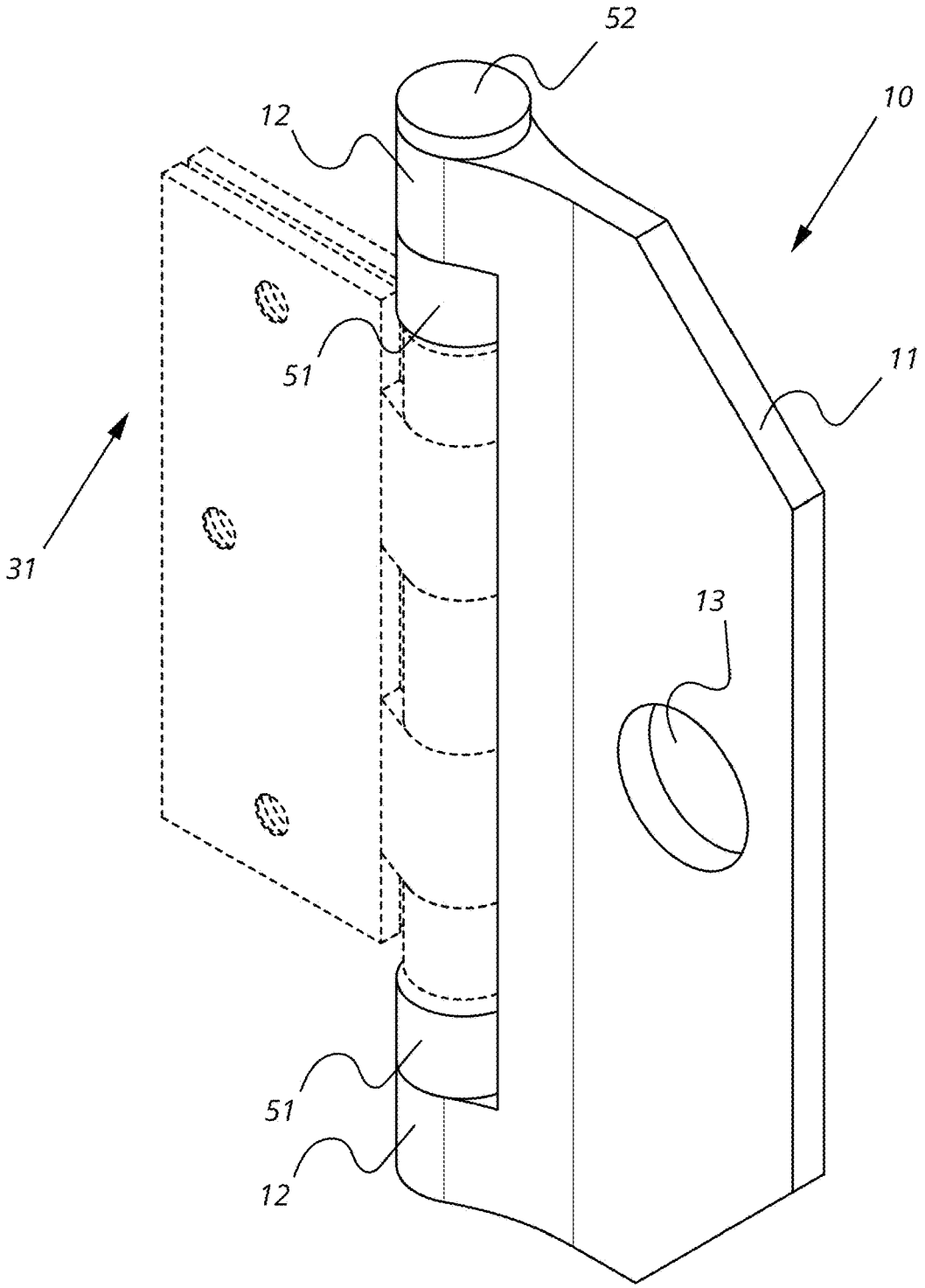
FIG. 7 is a perspective view of the hinge mount, the replacement hinge pin, and adapter shims of FIGS. 5 and 6 as installed on a small door hinge for which the adapter shims are suited.
Figure 8:
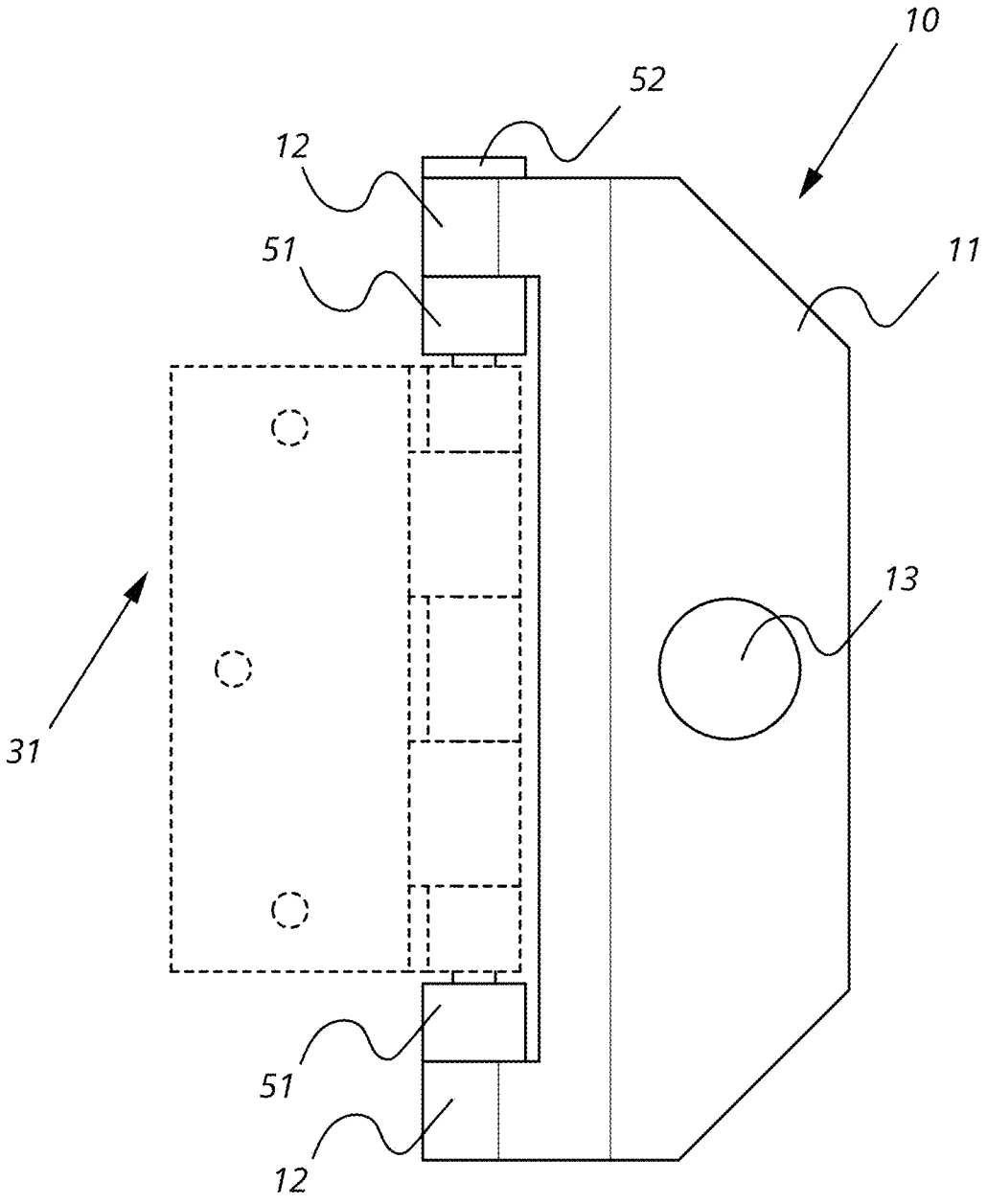
FIG. 8 is a side view of the embodiment of FIG. 7.

FIG. 7 is a perspective view of the hinge mount, the replacement hinge pin, and adapter shims of FIGS. 5 and 6 as installed on a small door hinge for which the adapter shims are suited. FIG. 7 shows the same door anchor configuration as FIG. 2, now with the inclusion of adapter shims 51 to accommodate a smaller door hinge by a large-sized door anchor 10. As shown in FIG. 7, each adapter shim 51 is disposed between the upper and lower knuckles 12 of the hinge mount 11. Each adapter shim 51 includes an axial bore therethrough that is aligned with the channel 92 (as shown in FIG. 13) defined by the knuckles 12, so as to receive the replacement hinge pin 52. The adapter shims 51 have axial dimensions sufficient to consume a preponderance of any axial distance, between the upper and lower knuckles 12 of the hinge mount 11, that remains after considering the axial distance of the interlaced set of knuckles 23, 24. FIG. 8 is a side view of the embodiment of FIG. 7.

An embodiment of the present invention integrates softer, elastic, and/or more pliable materials either as coatings, attachments, or separate element to the door anchor, such that the door anchor, when not attached to the door hinge. By integrating such materials, the door anchor may also be used as a "stop" anchor by being rested against a closed door frame or jamb, and physically resisting forces exerted from the opposite side of the door. In an embodiment of the present invention, the door anchor may be integrated into an exercise system, rather than acting as a separate component. For example, in a strap-based exercise system, an example embodiment of the door anchor is permanently sewn into the straps, rather than attaching via a carabiner.

Other embodiments of the present invention combine two or more of the components of the door anchor, while excluding or altering other components of the door anchor. For example, in an embodiment, the replacement hinge pin and the hole to attach exercises system may be combined to allow the attachment of a load from an exercise system directly to the replacement hinge pin, absent the inclusion of other components of the door anchor. In one embodiment, such attachment is achieved by extending the circular cross section of the replacement hinge pin, such that it forms a loop or other opening that might receive such load. In another embodiment, the same function might be achieved via geometry added to the door anchor that allows the door anchor to receive a loop of webbing or other element that, in turn, provides a load attachment point.

The embodiments of the invention described above are intended to be merely exemplary; numerous variations and modifications will be apparent to those skilled in the art. All such variations and modifications are intended to be within the scope of the present invention as defined in any appended claims.

What is claimed is:

1. A method of providing an anchor for an exercise system, the method comprising:

removing an original hinge pin from a hinge assembly that mounts a door in a frame in an opening, the hinge assembly including a first leaf mounted to the frame and a second leaf mounted to the door, the first and second leaves having an interlaced set of knuckles that define a passageway for the original hinge pin;

positioning a mount having spaced-apart first and second knuckles configured (i) to span the interlaced set of knuckles of the first and second leaves and (ii) to define a channel, so that when the mount is positioned, the channel is aligned with the passageway; and installing a replacement hinge pin, longer than the original hinge pin, so as to occupy the passageway and the channel and to transform the mount into an anchor.

2. A kit to provide an anchor for an exercise system, the kit comprising:

a mount having spaced-apart first and second knuckles configured (i) to span an interlaced set of knuckles of first and second leaves of a standard hinge assembly that mounts a door in a frame in an opening, the interlaced set of knuckles defining a passageway for receiving an original hinge pin, and (ii) to define a channel having a diameter sufficient to accommodate the diameter of the original hinge pin; and a replacement hinge pin having a diameter that is not greater than a diameter of the original hinge pin and a length sufficient so that, when the mount is positioned so that the channel is aligned with the passageway, the replacement hinge pin, when inserted into the channel and the passageway, reaches the first and second knuckles of the mount defining the channel.

3. The kit according to claim 2, further comprising:

a set of adapter shims, each adapter shim configured, in use, to be disposed between the first and second knuckles of the mount and including an axial bore therethrough that is aligned with the channel, so as to receive therethrough the replacement hinge pin, the set of adapter shims having axial dimensions sufficient to consume a preponderance of any axial distance, between the first and second knuckles of the mount, that remains after considering the axial distance of the interlaced set of knuckles.

4. The kit according to claim 3, wherein:

a given adapter shim of the set of adapter shims is further configured to include (i) a primary section, occupying a majority of the given adapter shim's axial length and (ii) a stub section, occupying a minority of the given adapter shim's axial length;

the stub section has an outside diameter that is smaller than an outside diameter of the primary section; and the channel of an inner portion of each of the first and second knuckles of the mount is provided with an internal shoulder formed to receive the stub section.

5. The kit according to claim 3, wherein the mount includes a hole disposed therein to receive a clip for attaching an exercise system thereto.

6. The kit according to claim 3, wherein the axial distance between the first and second knuckles of the mount is 3½ inches to accommodate a standard 3½ inch hinge assembly.

7. The kit according to claim 3, wherein the axial distance between the first and second knuckles of the mount is 4½ inches to accommodate a standard 4½ inch hinge assembly, and first and second adapter shims of the set of adapter shins are configured to be attached to the first and second knuckles to accommodate a standard 3½ inch door hinge assembly.

* * * * *